US012152783B2

(12) United States Patent
Illotti

(10) Patent No.: US 12,152,783 B2
(45) Date of Patent: Nov. 26, 2024

(54) METHOD FOR THE REALIZATION OF COOKING APPARATUSES

(71) Applicant: I.L.V.E. S.P.A.-Industria Lavorazione Veneta Elettrodomestici S.p.A., Campodarsego (IT)

(72) Inventor: Carlo Illotti, Campodarsego (IT)

(73) Assignee: I.L.V.E. S.P.A.—INDUSTRIA LAVORAZIONE VENETA ELETTRODOMESTICI S.P.A., Campodarsego (IT)

( * ) Notice: Subject to any disclaimer, the term of this patent is extended or adjusted under 35 U.S.C. 154(b) by 451 days.

(21) Appl. No.: 17/623,874

(22) PCT Filed: Jul. 9, 2020

(86) PCT No.: PCT/IB2020/056460
§ 371 (c)(1),
(2) Date: Dec. 29, 2021

(87) PCT Pub. No.: WO2021/005548
PCT Pub. Date: Jan. 14, 2021

(65) Prior Publication Data

US 2022/0364735 A1 Nov. 17, 2022

(30) Foreign Application Priority Data

Jul. 9, 2019 (IT) ..... 102019000011274

(51) Int. Cl.
*F24C 15/00* (2006.01)
*F24C 3/00* (2006.01)
*F24C 15/08* (2006.01)

(52) U.S. Cl.
CPC ..... *F24C 15/08* (2013.01); *F24C 3/008* (2013.01)

(58) Field of Classification Search
CPC ..... F24C 15/08; F24C 15/007; F24C 15/16; F24C 3/008
USPC ..... 126/273 R
See application file for complete search history.

(56) References Cited

U.S. PATENT DOCUMENTS 2,161,537 A 6/1939 Sockstrom et al.
2,512,118 A * 6/1950 Snow ..... F24C 15/08 126/41 R
2,675,797 A * 4/1954 Reeves ..... F24C 15/08 126/39 B (Continued)

FOREIGN PATENT DOCUMENTS

WO 2004070278 A1 8/2004
WO WO-2010034833 A1 * 4/2010 ..... F24C 15/08

*Primary Examiner* — Ko-Wei Lin
(74) *Attorney, Agent, or Firm* — Carmel Patent Agency; Robert Ballarini

(57) ABSTRACT

Method for making stand alone cooking appliances with a load-bearing structure including uprights, crosspieces and beams, with at least one oven muffle, with a hob and with at least one front panel arranged to receive the control and command elements of said muffle and/or said hob and with removable covering side panels, each removable covering side panel is mounted on said supporting structure by inserting it from the back so that at least one of its snap engagement elements provided near its front edge engages in a clip provided in the corresponding front upright of said bearing structure and then the rear edge of said panel is constrained to the corresponding rear upright of the structure itself.

10 Claims, 11 Drawing Sheets

(56) References Cited

U.S. PATENT DOCUMENTS

| | | | | |
|---|---|---|---|---|
| 2,798,785 | A * | 7/1957 | Chesser | F24C 15/08 312/265.1 |
| 3,402,281 | A | 9/1968 | Vonderhaar | |
| 5,928,540 | A | 7/1999 | Dominique et al. | |
| 2019/0184506 | A1 * | 6/2019 | Conde Zelocuatecatl | B23P 19/04 |

* cited by examiner

METHOD FOR THE REALIZATION OF COOKING APPARATUSES

FIELD OF THE INVENTION

The present invention relates to a method for making stand alone cooking appliances and a cooking appliance obtainable with the method.

BACKGROUND

The known stand alone cooking appliances comprise a self-supporting structure, generally paneled, obtained with elements of sheared and folded sheet metal, suitably welded or otherwise constrained to each other to form a box-like structure, to which an oven muffle is then applied to the front and above is inserted a hob of various types. The assembly is then completed with the application of a front panel, in which the controls and signalling accessories of the oven and hob are collected.

Alternatively, if an oven is not provided, the boxed structure, also made of sheet metal, has no oven, which is replaced by a compartment equipped with a front door or a set of drawers, and bears the top applied with a cooking hob with knobs and any accessories to signal its operation.

The sheets of the box-shaped supporting structure of the known stand-alone cooking appliances are generally made up of panels finished with a surface treatment or with a painting, which, in addition to performing an aesthetic function, also perform a structural function, in that, a once welded or joined together, they form the rigid box structure, suitable for supporting the weight of the oven, hob and related accessories.

Depending on the market demands or the manufacturer's proposals, the boxed structure of the well-known stand alone cooking appliances is made of chromed or satin-finished or painted sheet metal and generally protected by a coating film, which is then removed when the cooking appliance reaches its final destination.

However, these known solutions are not fully satisfactory for various reasons.

Depending on the model of cooking appliance, in fact, it requires a different box-shaped structure and this implies for the manufacturer the need to produce a large number of different structures, able to satisfy the different market demands, with consequent problems and costs of management.

Furthermore, this drawback does not only concern manufacturers of cooking appliances, but also distributors, who, in order to be able to satisfy customer requests without excessive delays, must have a large number of different models available at all times, with consequent problems and logistics costs.

Another drawback concerns the technical assistance for the cooking appliance, due to the difficulties in accessing the internal part of the appliance and more particularly the cavity that exists between the oven muffle and the sheet of the box structure and which in general houses the components of the oven and in particular electric motors, fans, probes, programming units, signal bulbs, etc.

Furthermore, the differences between the various models make the technician's work more complicated, who in the face of each fault can potentially be faced with a different situation, with different methods and disassembly sequences.

The above drawbacks are even more accentuated in more recent cooking appliances, given the large number of components, which in the past did not exist or were little used. In particular, today's hobs include electrical and/or electronic components, such as display control units, induction hob coils, and other various components and devices.

Similar drawbacks also concern the hob, which in case of maintenance to its internal components must be able to be completely removed from the box structure, on which it is mounted, to allow access to the burners, gas taps, spark plugs and to safety thermocouples.

Furthermore, in the event of surface damage to the coating sheets, for example due to scratches caused during transport or during storage or during use by the end user, or even simply due to changed aesthetic needs of the end user himself, it is necessary to repaint the entire cooking appliance, with the consequent drawbacks in terms of costs and usability of the appliance.

This drawback is particularly frequent in the case of traditional cooking appliances, since the known production processes firstly involve completing the box-shaped structure and then inserting the hob into it, forcing the manufacturer to carry out work on an already finished piece, which more easily it can be damaged during assembly operations.

WO2004/070278 describes an assembly for a cooking hob which includes a structure formed by a lower frame and an upper frame made of profiled elements, secured to four vertical columns. The same columns are also associated in a removable manner with the panels that define a compartment, inside which at least one muffle can be inserted, and above which a cooking top can be applied with a front panel equipped with the relative control instruments. There are also side panels that completely cover the assembly.

This solution is not fully satisfactory since if the panels are damaged it is necessary to replace them.

U.S. Pat. No. 2,798,785 describes a method of construction of kitchen cabinets which comprises a frame to which a plurality of cover panels are applied. In particular, moreover, the described solution provides for the use of side panels which completely cover the assembly. This is not fully satisfactory since in case of damage it is necessary to replace the entire panel.

SUMMARY

The object of the invention is to provide a stand alone cooking appliances which are, at least in part, free from the drawbacks mentioned above and present in traditional solutions.

In particular, the object of the invention is to propose a method for making cooking appliances, which allows to standardize production.

Another object of the invention is to propose a method for making cooking appliances, which uses panels without any structural function.

Another object of the invention is to propose a method for making cooking appliances which allows to modify the external appearance of the appliance itself according to the customer's requests.

Another object of the invention is to propose a method for making cooking appliances which, compared to traditional stand alone cooking appliances, makes maintenance and repair operations somewhat easier.

Another object of the invention is to propose a method for making cooking appliances which are alternative and improved over the traditional methods.

Another object of the invention is to propose a method for making cooking appliances which can be easily and quickly implemented and with low costs.

Another object of the invention is to propose a stand alone cooking appliance which can be obtained easily, quickly and with low costs.

Another object of the invention is to propose a stand alone cooking appliance that can be customized easily, quickly and with low costs.

All these purposes, considered individually or in any combination thereof, and others which will result from the following description are achieved, according to the invention with a method for making stand alone cooking appliances and with an appliance of cooking as defined in the appended claims.

BRIEF DESCRIPTION OF THE DRAWINGS

The present invention is further clarified below in some of its preferred forms of practical embodiment, given purely by way of non-limiting example with reference to the attached drawings, in which.

DETAILED DESCRIPTION OF THE PREFERRED EMBODIMENTS

In the following, the front side of the kitchen appliance means the side exposed to view where the oven doors are positioned, and in any case the side where a user is usually located.

Hereinafter, the rear side refers to the side which is usually closest to the wall, or the side opposite to said front side.

With reference to the figures, it can be recognized that the method according to the invention provides for making the cooking appliance with a series of operating steps to be performed in a certain sequence.

The cooking appliance obtainable with the method is exemplified in an oven made with a single muffle, even if it is foreseen that it can be made with two muffles 10, 10' side by side, mounted inside a single supporting structure.

Figure 1:
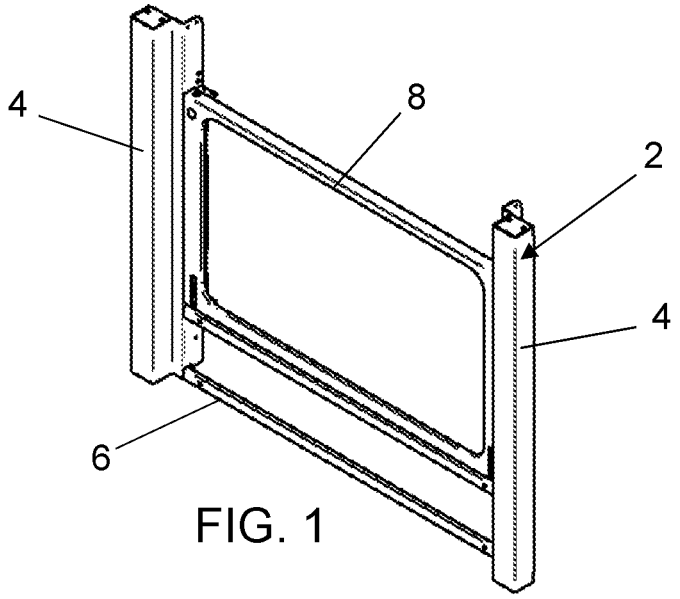
FIG. 1 shows a perspective view the front frame of the self-supporting structure of the cooking appliance according to the invention.

The first phase of the method according to the invention provides for making a front frame 2 (FIG. 1), formed by a pair of uprights 4, made of tubular metal section and joined together by a lower rail 6, which for example can correspond to a first crosspiece 6, and to a frame 8 intended to constrain an oven muffle 10.

The constraint of the frame 8 and of the crosspiece 6 to the two uprights 4 is preferably obtained with rivets or with screws or also by spot/welding, while the various components are provisionally stabilized in the correct mutual position with the use of a special template (not represented) on which they are individually mounted.

The connection of the muffle 10 to the frame 8, on the other hand, is obtained with screws, to allow for its possible disassembly in case of need, for example for its replacement.

Figure 2:
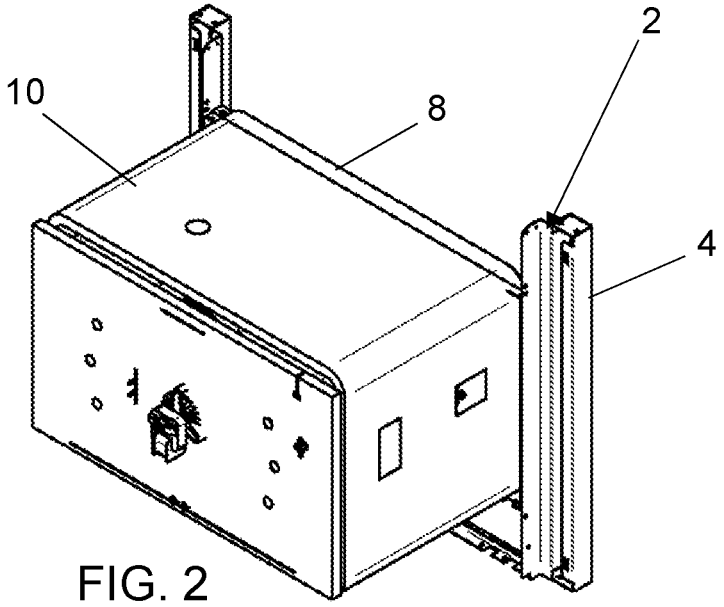
FIG. 2 shows it in perspective view after the application of the oven muffle.

After the muffle 10 has been applied to the front frame 2 (FIG. 2), a rear frame 12 is made separately on a different template, but with methods similar to those followed for the construction of the front frame 2.

Figure 3:
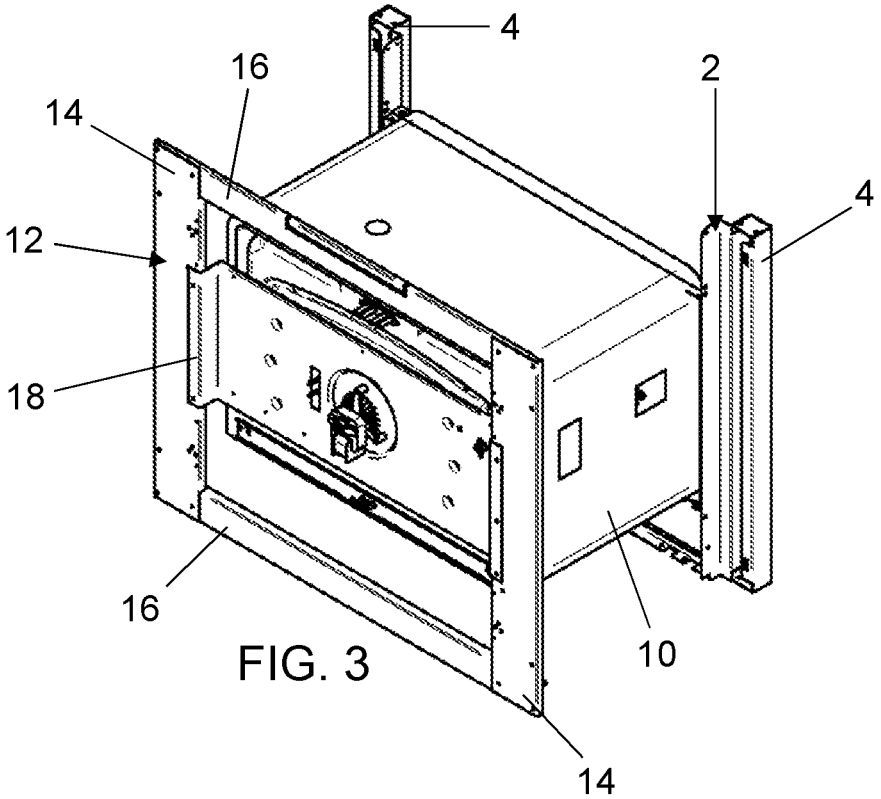
FIG. 3 shows it in perspective view with the muffle already attached to the front frame and to the rear frame of the self-supporting structure.

This rear frame 12 it comprises two uprights 14 joined by two second crosspieces 16 and by a central band comprising for example a third crosspiece 18, which constitutes the rear support of the muffle 10 (FIG. 3).

Figure 4:
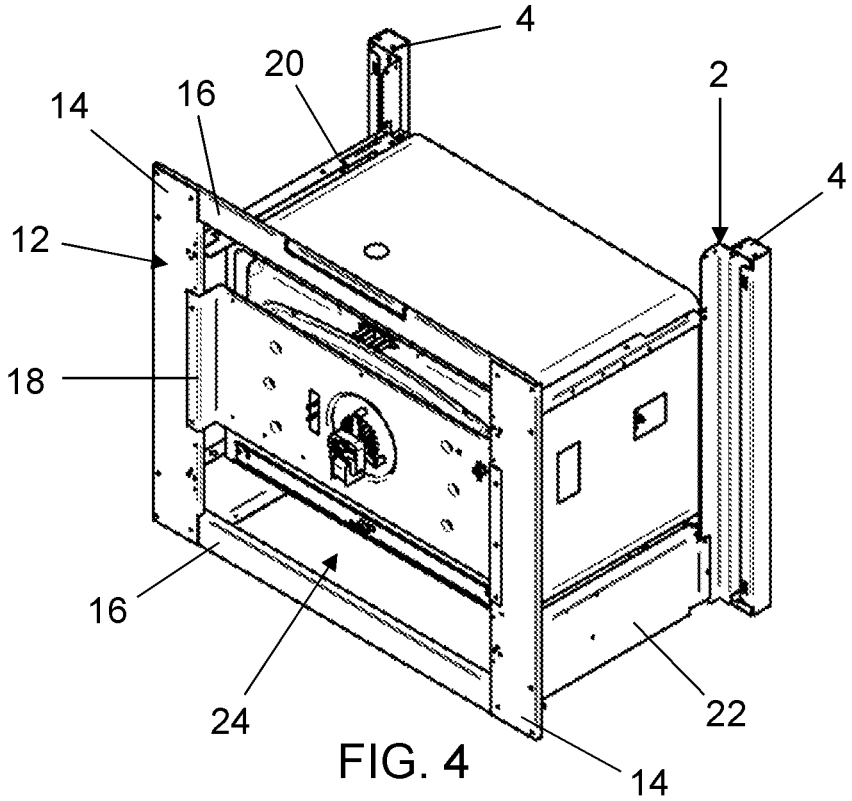
FIG. 4 shows it in a successive phase of the realization method.

The two front 2 and rear 12 frames are further stabilized with each other with upper 20 and lower 22 beams, which overall create a rigid parallelepipedic structure of the entire cooking appliance (FIG. 4). Furthermore, the lower beams 22 also constitute lateral delimitation elements of a compartment 24 below the muffle 10.

Figure 5:
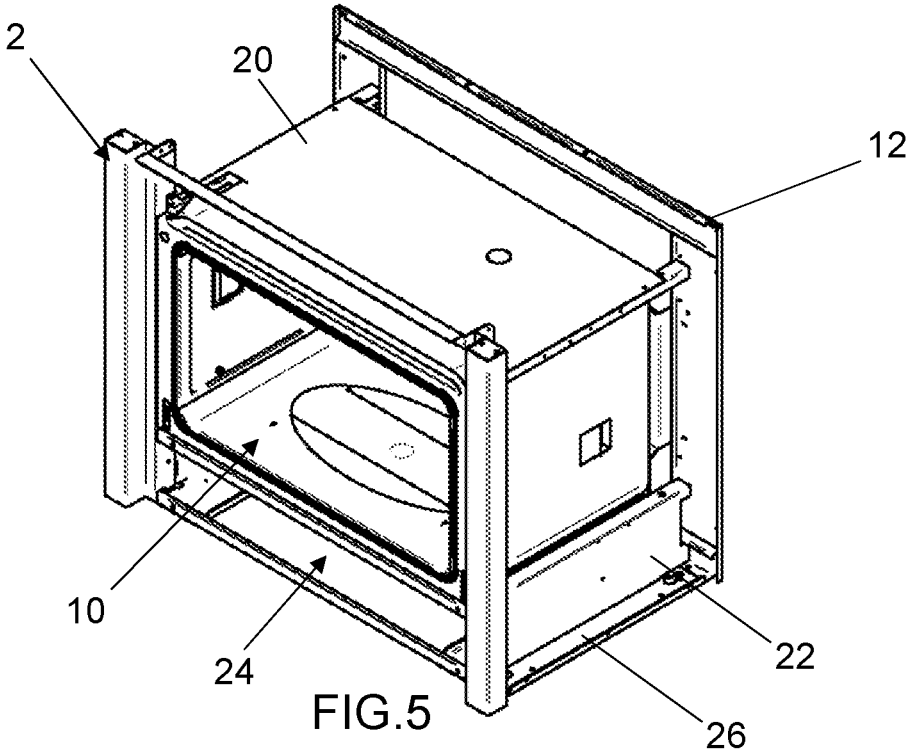
FIG. 5 shows it in perspective view in a further realization phase.

Two brackets 26 are applied to the structure thus inferior, which will subsequently be used for fixing the legs (not shown) of the cooking appliance (FIG. 5).

Figure 6:
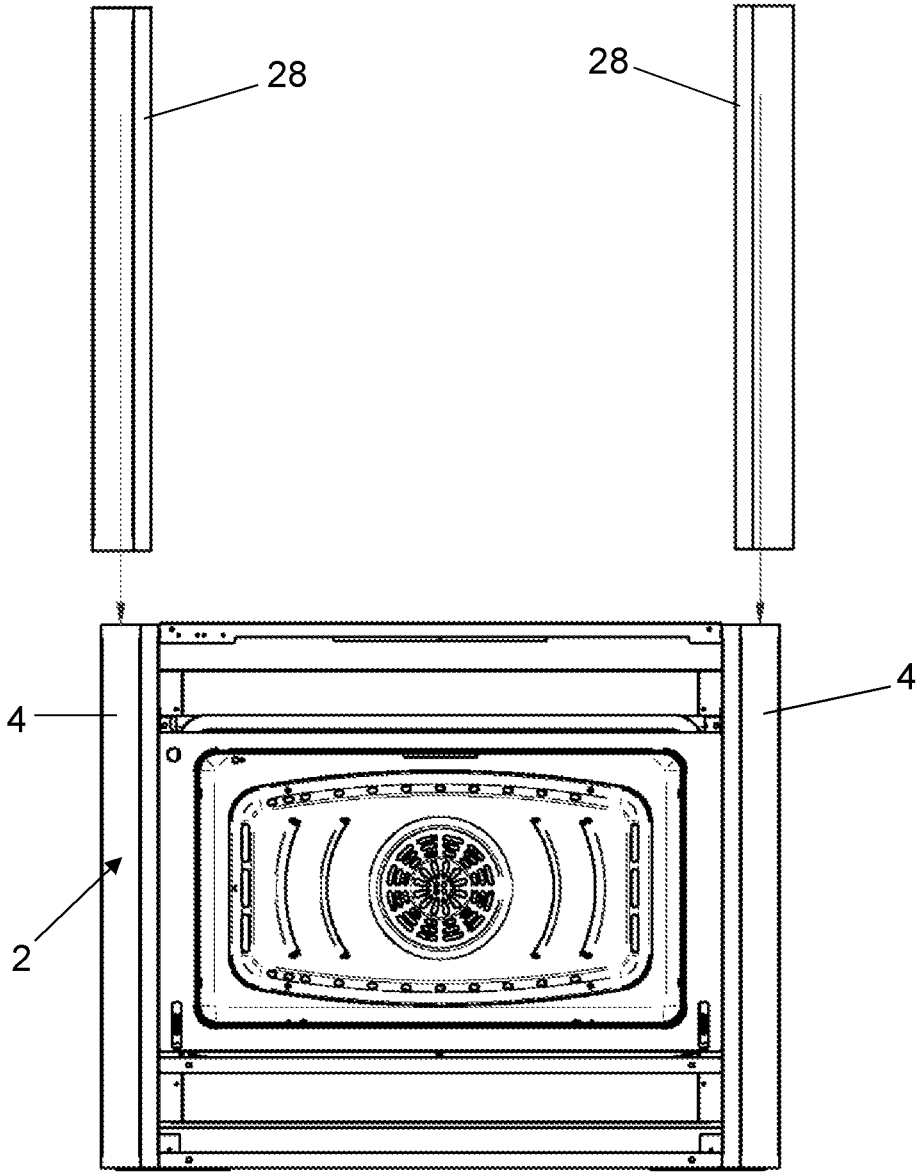
FIG. 6 shows it in front view in the phase of the application of the covering profiles to the uprights of the front frame.

Subsequently, on the two front uprights 4 of the structure thus made, two covering profiles 28 are fitted from above (FIG. 6), which have the function of covering the uprights themselves and therefore of covering them with ornamental elements chosen on the basis of the exterior appearance that the cooking appliance must present.

Advantageously, the covering profiles 28 can have a substantially tubular structure, and preferably cover substantially only the front uprights 4.

For example, the covering profiles 28 can be made with different materials or finishes with respect to the other components of the cooking appliance (and in particular compared to the side cladding panels, as will be clear later). This is because the covering profiles, being positioned at the front corners of the cooking appliance, are the elements that are more exposed than others, and therefore they are the first to be damaged in the event of a collision with foreign bodies and can advantageously be made with more resistant materials or at least they can be treated with more resistant enamels or paints.

Advantageously, if the cooking appliance provides more than one muffle 10, for example two muffles 10, 10', it can also comprise a pair of front frames 8, 8' capable of supporting the two muffles separately.

Advantageously, as shown in FIGS. 15 to 19, the front frame 2 can be divided into two portions by means of a first front intermediate upright 50, and also the rear frame 12 can be divided into two portions by means of a second rear intermediate upright 50' and both these intermediate uprights 50, 50' are advantageously positioned at the separation between the two muffles 10, 10'.

Figure 15:
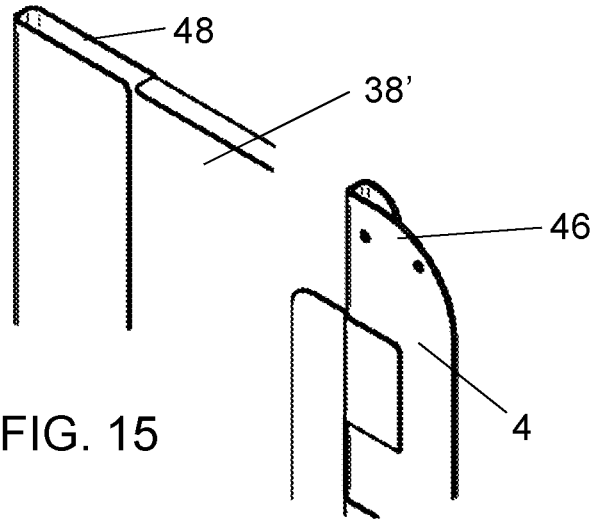
FIG. 15 shows an exploded perspective view of the two elements of the panel and of the upright interested in the reciprocal constraint.
Figure 16:
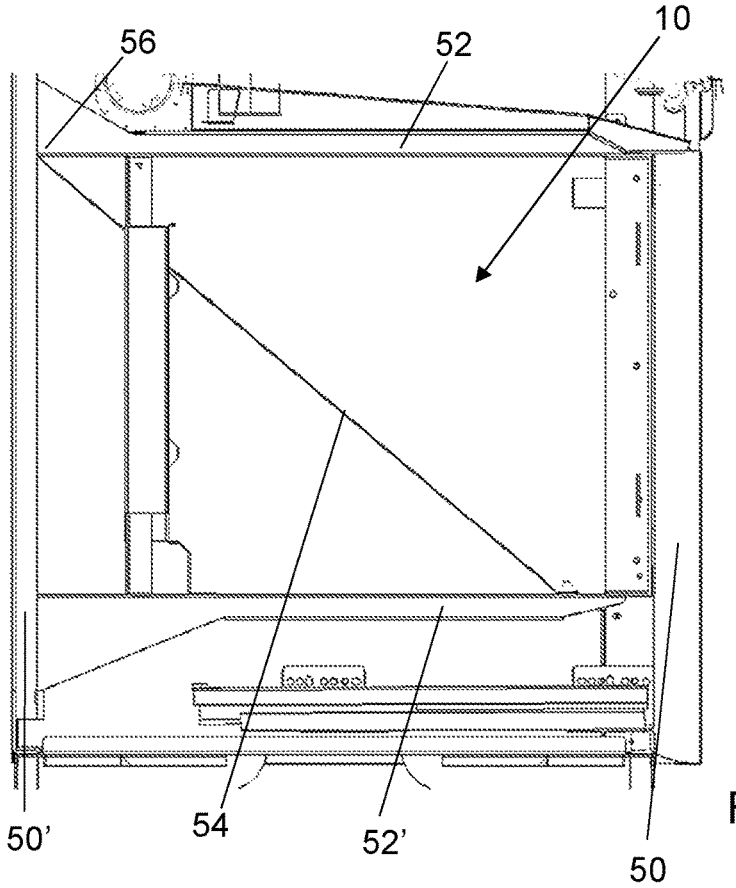
FIG. 16 shows a side view of the frame of the cooking appliance according to the invention in the form made with two ovens.
Figure 17:
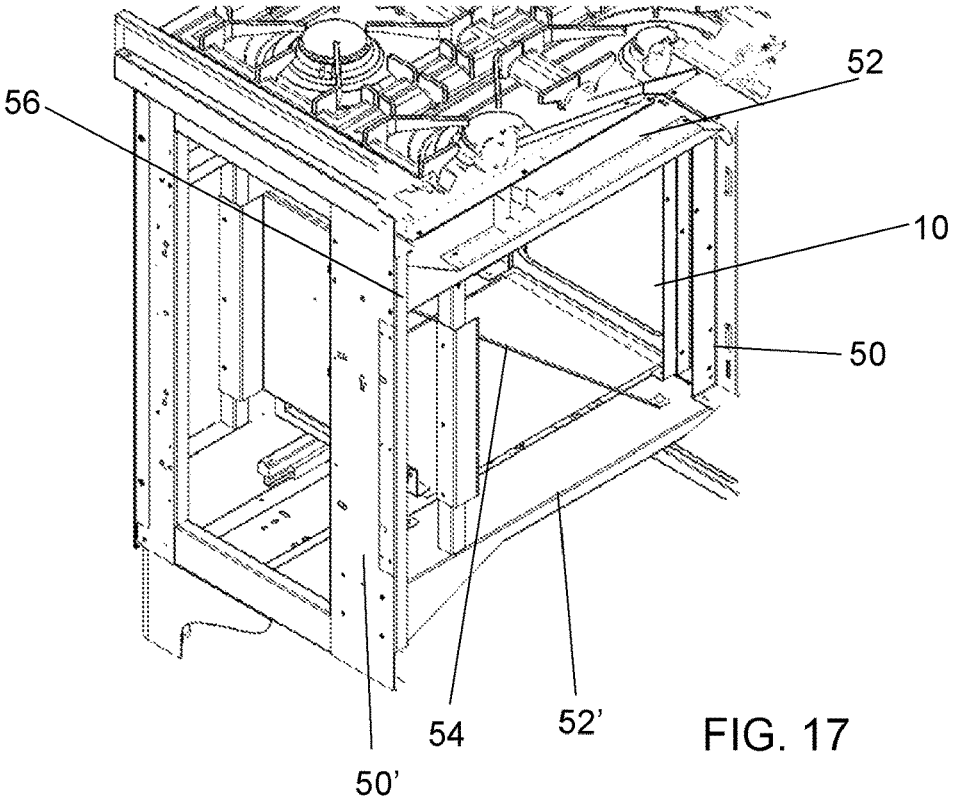
FIG. 17 shows it in partial rear perspective view.
Figure 18:
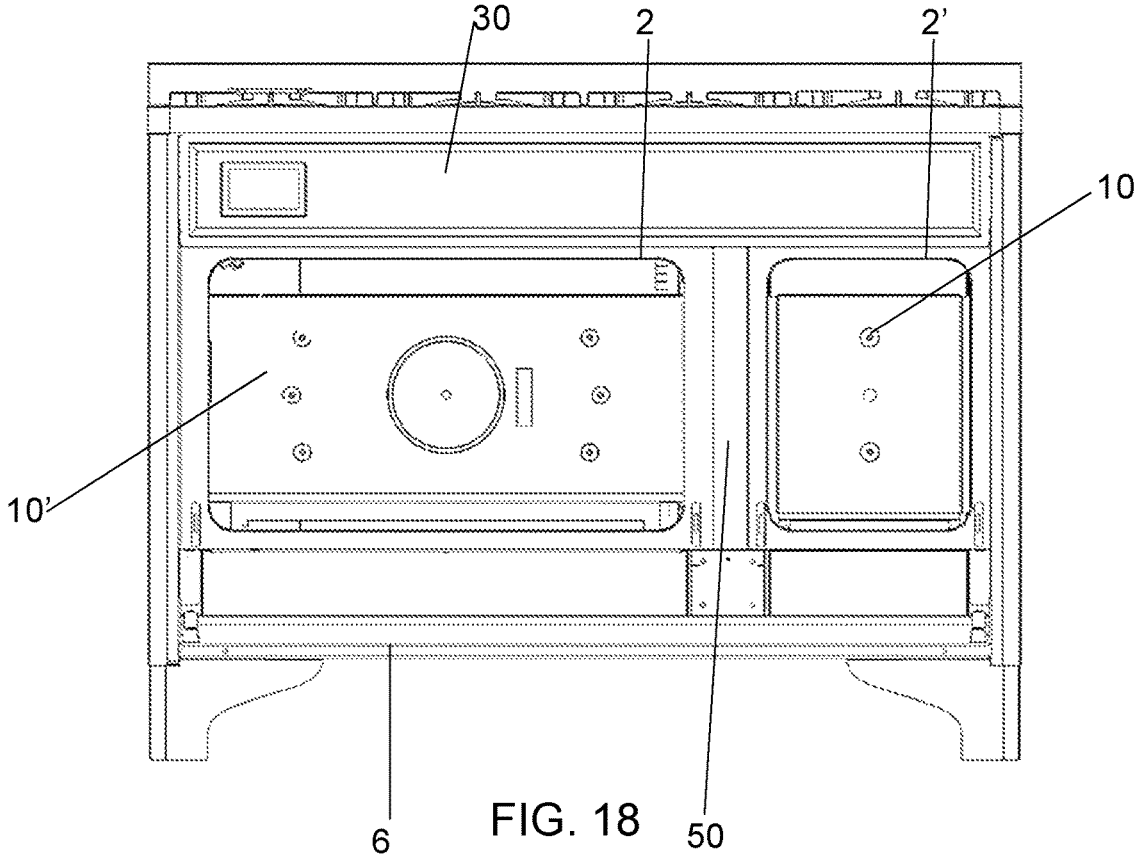
FIG. 18 shows it in front view.
Figure 19:
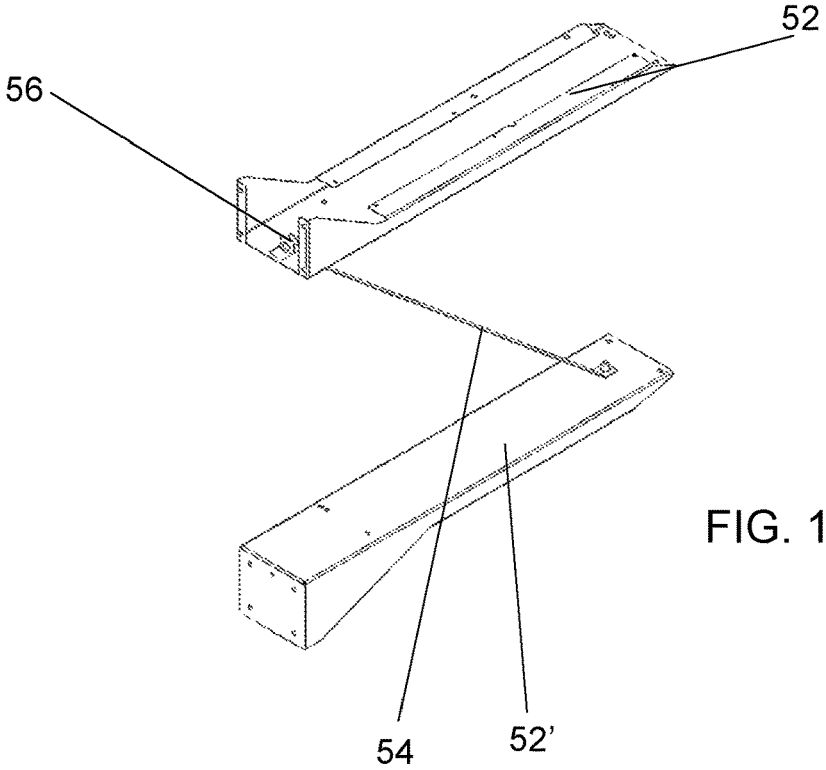
FIG. 19 shows in rear perspective view the detail of the two intermediate beams and the tie rod that connects them.
Figure 20:
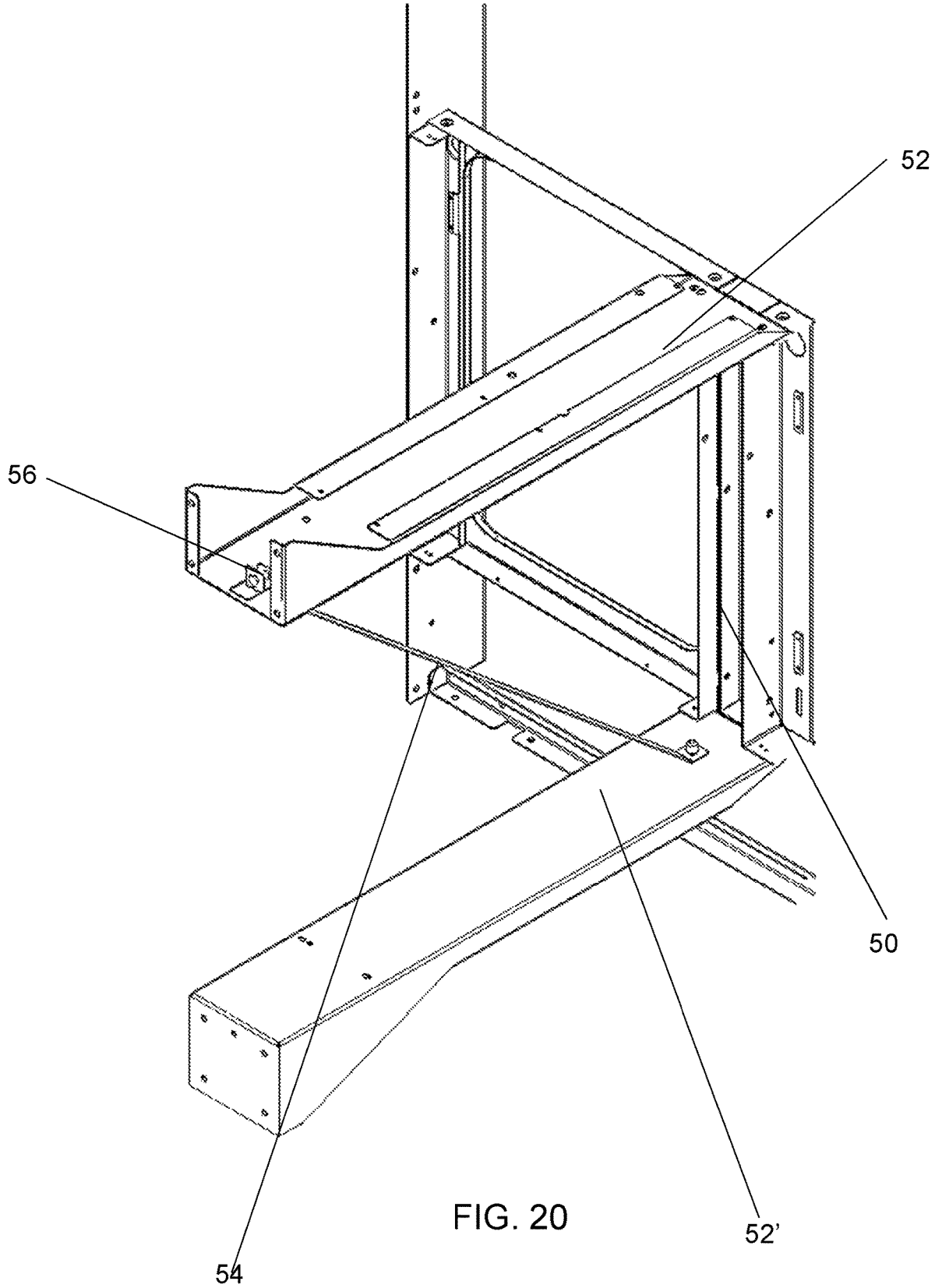
FIG. 20 shows them in perspective view associated with the intermediate upright.

Both ends of the two intermediate uprights 50, 50' are then connected to each other by two intermediate currents, one upper 52 and one lower 52' (see FIGS. 15 and 16). Preferably the constraint between each intermediate upright 50, 50' and each intermediate current 52, 52' is obtained with screws.

The opposite ends of these two intermediate currents 52, 52', and more specifically the front end of the lower intermediate current 52' and the rear end of the upper intermediate current 52 are advantageously connected together by a tie rod 54, at the upper end of which an adjustment screw 56 is suitably associated. In this way it is possible to slightly deform the frame formed by the two intermediate uprights 50, 50' and the two intermediate currents 52, 52', in order to adjust the perfect alignment of the two doors of the two muffles 10, 10'.

Figure 7:
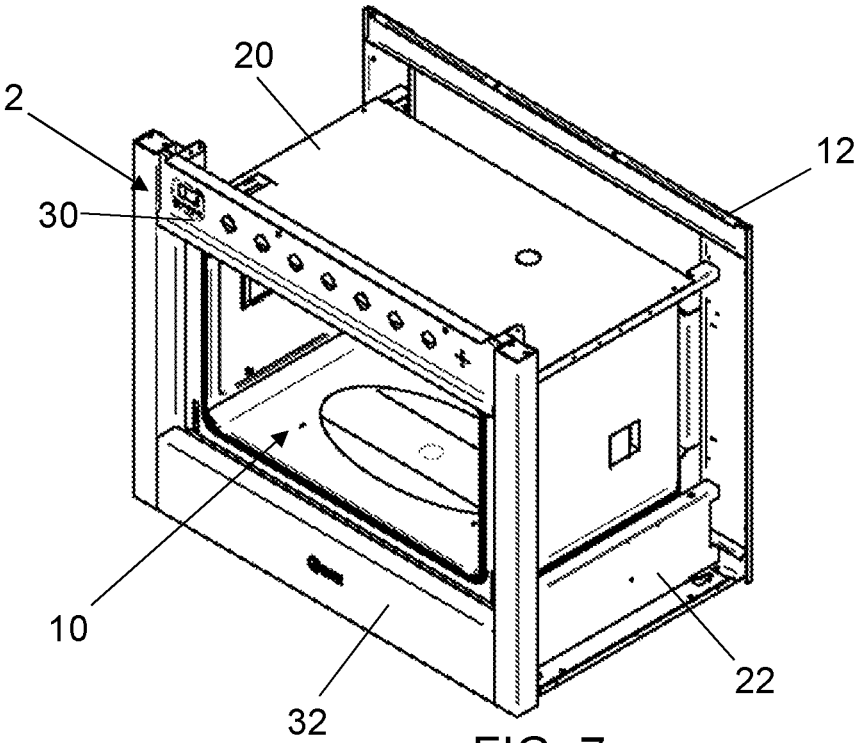
FIG. 7 shows it in perspective view in a subsequent realization phase.

An upper front panel 30 is then applied to the front of the structure, intended to receive the control elements of both the oven and the hob, and a lower front panel 32 (FIG. 7) at the bottom, which can be fixed, if the compartment is 24 must not be used, or foldable, if compartment 24 is to be used, or it can be the front of a drawer, in the case of compartment 24 it is intended to house a drawer.

Figure 8:
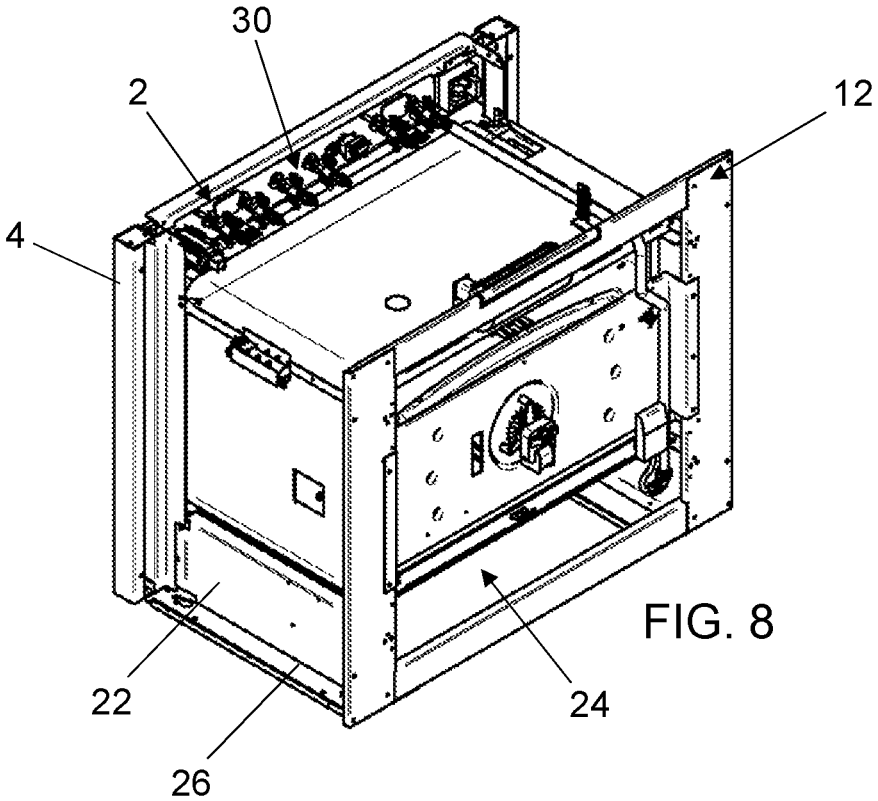
FIG. 8 shows it in a rear perspective view after the application of the controls on the front panel.

After assembling the upper front panel 30, all the controls for operating the oven and hob are applied to it, i.e. switches, thermostats, oven timers and taps for the hob 34 (FIG. 8), which subsequently it is applied to the load-bearing structure and tied to the two front uprights 4, already covered with the covering profiles 28.

After the cooking hob 34 is assembled, the front door 36 of the muffle 10 is applied, and subsequently to the structure of the appliance they are applied two side cladding panels 38, made of painted or chromed sheet metal or in any case surface treated.

Figure 9:
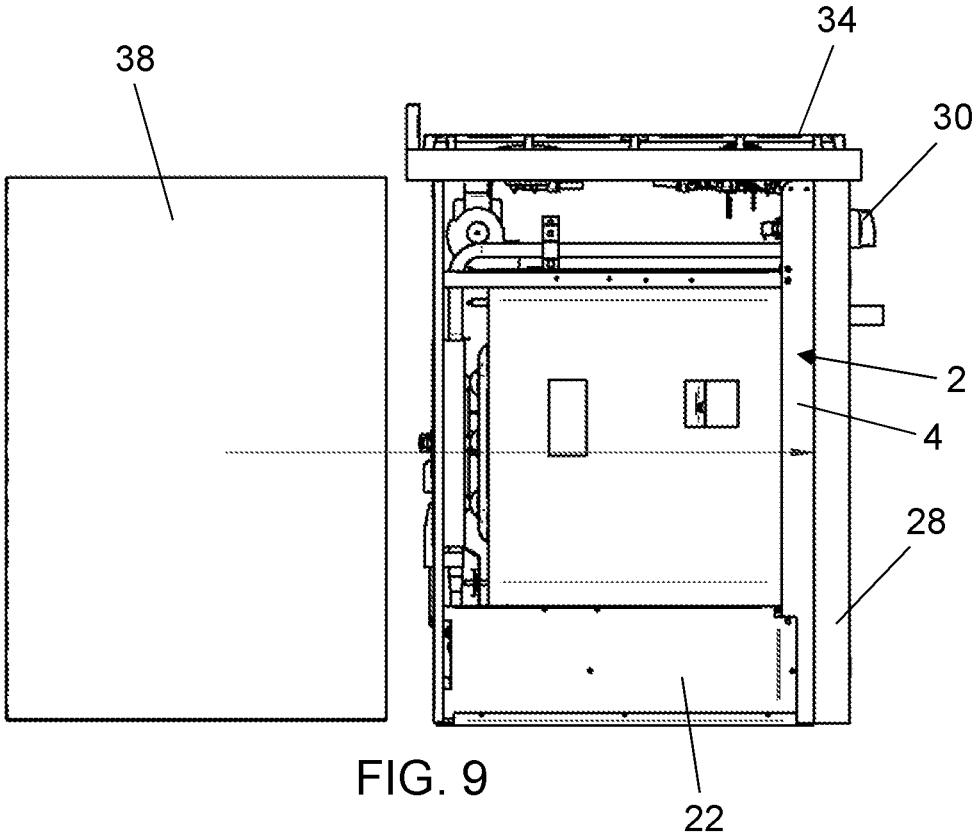
FIG. 9 shows it during the application of the side cladding panels.
Figure 10:
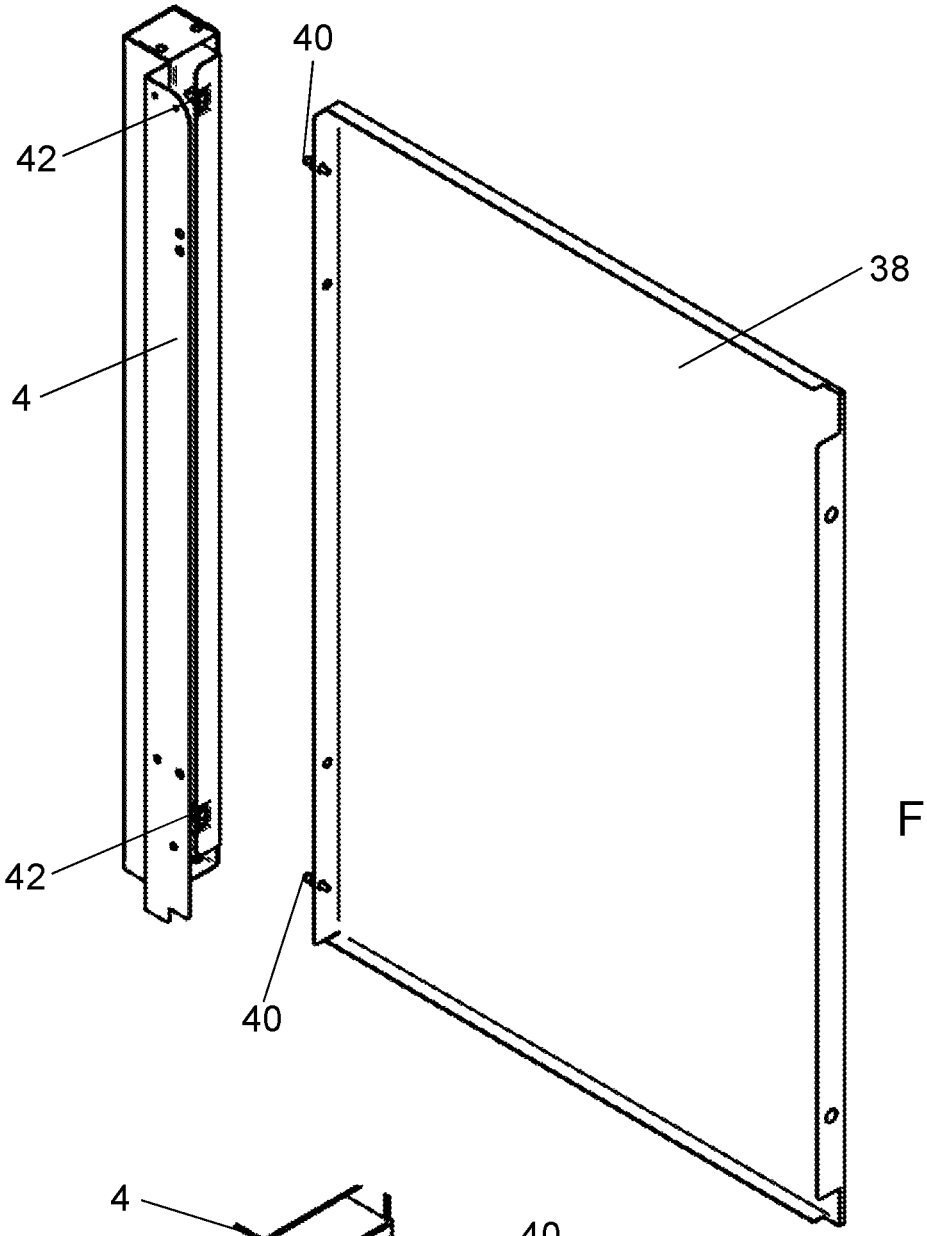
FIG. 10 shows a perspective exploded view of the separate covering elements in a first embodiment.
Figure 11:
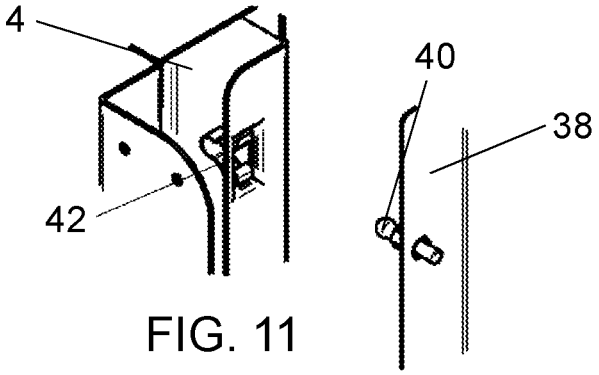
FIG. 11 shows an exploded perspective view of the two elements of the panel and of the upright involved in the reciprocal constraint.
Figure 12:
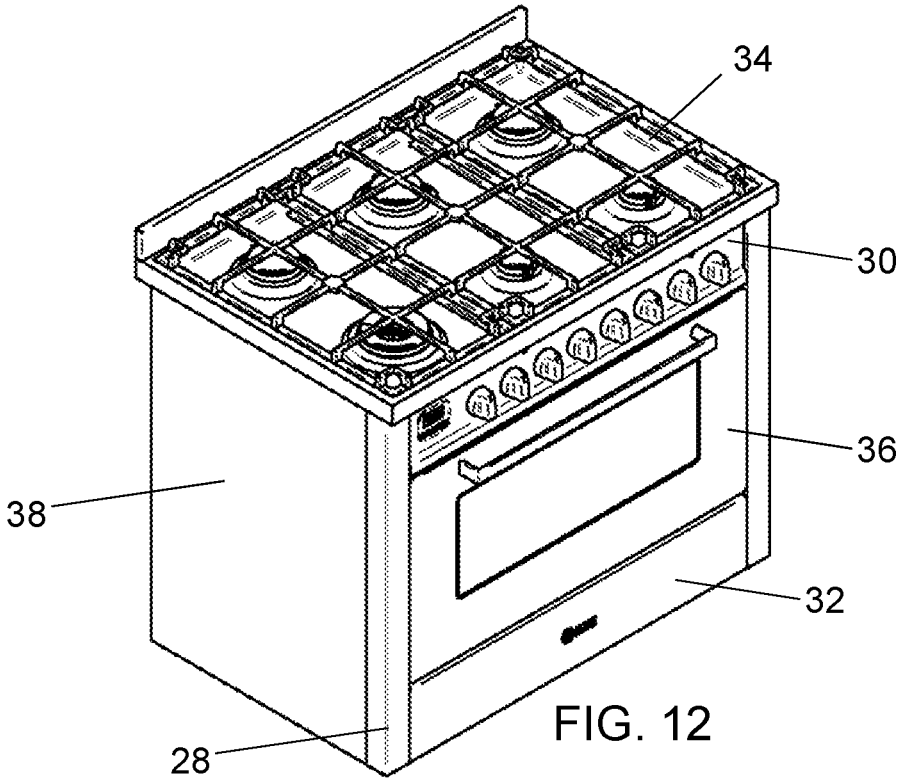
FIG. 12 shows a front perspective view of an already made cooking appliance.

This operation requires that each panel 38 be inserted from the rear to the front of the cooking appliance, sliding it with its horizontal edges between the hob 34 and the corresponding bracket 26, until it engages with its front edge in the covering profile 28 of the front upright 4 (FIG. 9). More particularly, as shown in FIGS. 10 and 11, at the end of this insertion stroke, a pair of pins 40 fixed to the folded front vertical flap of each side panel 38 engage by snapping into corresponding clips 42 previously positioned within special seats made in the corresponding front uprights 4. The stabilization of each side panel 38 then takes place with screws, which secure its folded rear flap to the corresponding upright 14 of the rear frame 12.

Figure 13:
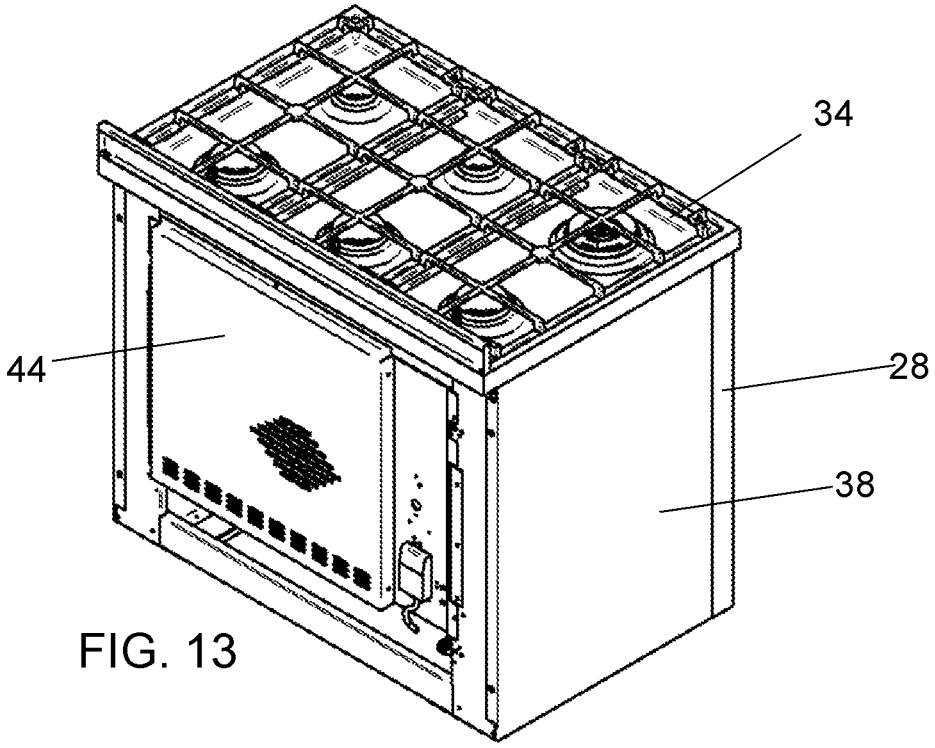
FIG. 13 shows it in a rear perspective view.

Finally, a rear closure panel 44 of the cooking appliance is provided (see FIG. 13).

A cooking appliance is thus constructed comprising:

one or two oven muffles 10, a hob 34, a pair of frames 2, 12 configured to support the muffle 10 and the hob 34, at least a pair of beams 20, 22 to stabilize the two frames 2, 12, which are already provisionally stabilized thanks to their connection to the muffle 10, and to create, together with said frames, a substantially parallelepipedic bearing structure, a central band, comprising for example the third crosspiece 18, forming part of the rear frame 12 and configured to improve the structural properties of the frame itself and to contribute to the support of the muffle 10, a frame 8 secured to the front frame 2 and configured to support said muffle 10, at least a pair of horizontal brackets 26 configured for fixing legs or similar supporting elements of the cooking appliance to the floor, a plurality of covering profiles 28 configured to cover, at least partially, the front uprights 4 of the frames 2, 12, an upper front panel 30 configured to accommodate the controls of the hob 34 and the muffle 10, a lower front panel, configured to allow access to a compartment 24 located in a lower position than the muffle 10, and removable side panels 38 for lateral closure of said parallelepipedic structure.

Conveniently, the cooking appliance described here is modular, and the individual components can be easily replaced with others, according to the needs of the user, and can also be removed if necessary, for example for maintenance. The standardization of the pieces also makes it possible to keep the production process lean, reducing storage necessities.

Advantageously, moreover, the method according to the invention allows a rapid construction of the cooking appliance itself, both for a series production in a production line, and for a production customized according to the needs of the user.

Moreover, thanks to the assembly of the side panels 38 in the final phase of construction of the cooking appliance, the risks of damaging these panels during the assembly operations of the muffle 10 and of the cooking hob 34 are practically eliminated.

Figure 14:
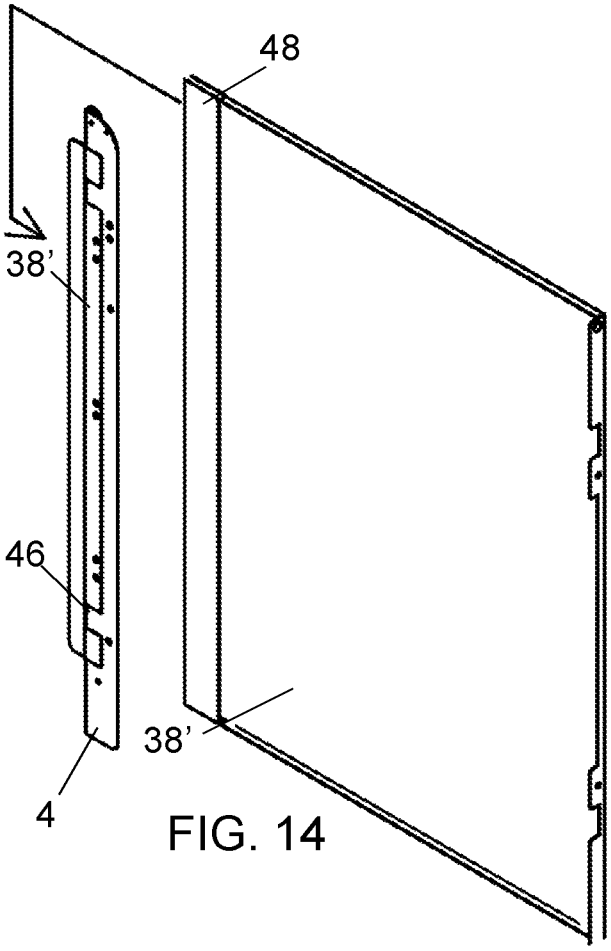
FIG. 14 shows an exploded perspective view of the separated covering elements in a second embodiment.

The embodiment illustrated in the FIGS. 14 and 15 differs from the one now described in that they are free of covering profiles 28 of the uprights 4 of the front frame 2. In this embodiment, the uprights 4 of the front frame 2 have a shape such as to highlight a lateral wing 46 facing forward to be engaged by hooking from the front vertical flap 48 of the side panels 38', folded backwards.

In this case, the assembly of each side panel 38' occurs by hooking with a sliding movement of the panel 38' backwards and with a subsequent constraint of the rear vertical flap folded of this with the corresponding upright 14 of the rear frame 12.

The invention claimed is:

1. Method for making a stand-alone cooking appliance with a load-bearing structure comprising front uprights (4), and rear uprights (14), joined together by crosspieces (6,16, 18) and beams (20,22,26), with at least one oven muffle (10, 10'), with a hob (34) and with at least one front panel (30) arranged to receive control and command elements of said muffle and/or said hob and with removable covering side panels (38), the method comprising:

mounting each removable covering side panel (38) on said load-bearing structure by inserting the removable covering side panel (38) from a rear portion of the cooking appliance to a front portion of the cooking appliance, sliding the removable covering side panel with horizontal edges thereof between said hob (34) and lower beams, (26) joining the front uprights (4) with the respective rear uprights (14) until at least one snap engagement element (40) provided near a front edge of the removable covering side panel (38) engages in a clip (42) provided in a corresponding front upright (4) of said load-bearing structure and then a rear edge of said removable covering side panel (38) is constrained to a corresponding rear upright (14) of the load-bearing structure itself, wherein tubular covering elements (28) are placed on said front uprights (4) before mounting said hob (34) on said load-bearing structure.

2. The method according to claim 1, wherein the at least one snap engagement element (40) is applied to the front edge of said side panel (38) and protrudes forward in the clip (42) arranged in the corresponding front upright (4) of said load-bearing structure.

3. The method according to claim 1, wherein said tubular covering elements (28) are placed on said front uprights (4) after having mounted said at least one oven muffle (10, 10') on said load-bearing structure.

4. The method according to claim 1, further comprising:

forming a front frame (2) of said load-bearing structure and constraining said at least one muffle (10, 10') thereto, forming, separately, a rear frame (12) of said load-bearing structure, tying the rear frame (12) directly to said at least one oven muffle (10,10') and, by means of the beams (20,22,26), to said front frame (2), thereby forming said bearing structure, to which said at least one oven muffle (10, 10') is already bound, constraining said front panel (30) to said at least one front frame (2) of said load-bearing structure, mounting said hob (34) on said load-bearing structure, applying said removable covering side panels (38) to said load-bearing structure, on which said at least one oven muffle (10, 10') and said hob (34) are already mounted.

5. The method according to claim 1, wherein after having formed said load-bearing structure, the beams (22) constituting lateral delimitation elements of an underlying compartment (24) are applied thereto, to a lower portion of said at least one oven muffle.

6. The method according to claim 4, wherein said front frame (2) and said rear frame (12) are divided into two portions respectively by means of a first front intermediate upright (50) and a second rear intermediate upright (50'), having the respective upper and lower ends connected to each other by means of upper (52) and lower (52') intermediate currents, the two portions of said front frame (2) being configured for the application of said at least one oven muffle placed side by side (10, 10').

7. A stand-alone cooking appliance comprising a load-bearing structure, comprising front uprights (4) and rear uprights (14) joined together by crosspieces (6,16,18) and beams (20,22,26), with muffles (10,10') placed side-by-side, a cooking hob (34) and a front panel (30), mounted on said load-bearing structure, and removable side panels (38, 38') for covering said load-bearing structure, wherein each removable side panel (38) is mounted on said load-bearing structure by inserting it from the rear to the front of the cooking appliance, sliding it with its horizontal edges between said hob (34) and lower beams (26) joining the front uprights (4) with the respective rear uprights (14) until at least one of its snap engagement elements (40) provided near its front edge engages in a clip (42) provided in the corresponding front upright (4) of said load-bearing structure and then the rear edge of said side panel (38) is constrained to the corresponding rear upright (14) of the load-bearing structure itself, wherein a front frame (2) and a rear frame (12) are divided into two portions respectively by means of a first front intermediate upright (50) and a second rear intermediate upright (50'), having the respective upper and lower ends connected to each other by means of an upper (52) and a lower (52') intermediate currents, the two portions of said front frame (2) being configured for the application of said muffles placed side by side (10, 10'), and wherein a frame defined by said intermediate uprights (50, 50') and by said intermediate currents (52, 52') comprises at least one diagonal tie rod (54) provided with adjustment screws.

8. The cooking appliance according to claim 7 wherein said side panels (38) comprise the at least one snap engagement element (40) applied to the front edge of said side panel and protruding forward to snap-engage in an applied clip (42) to said front upright (4).

9. The cooking appliance according to claim 7, further comprising tubular covering elements (28), fitted on said front uprights and distinct from said side panels (38).

10. The cooking appliance according to claim 9 wherein said tubular covering elements (28) covering said front uprights (4) are made of different material and/or have different finishes with respect to said side panels (38).

* * * * *